US011351580B2

(12) United States Patent
Emrem et al.

(10) Patent No.: US 11,351,580 B2
(45) Date of Patent: Jun. 7, 2022

(54) WINDOW CLEANING ROBOT

(71) Applicant: Fatih Emrem, Gebze/Kocaeli (TR)

(72) Inventors: Fatih Emrem, Gebze/Kocaeli (TR); Aykut Bilici, Gebze/Kocaeli (TR)

(73) Assignee: TOWER CRAFT, INC., Wood Dale, IL (US)

( * ) Notice: Subject to any disclaimer, the term of this patent is extended or adjusted under 35 U.S.C. 154(b) by 533 days.

(21) Appl. No.: 16/470,944

(22) PCT Filed: May 29, 2017

(86) PCT No.: PCT/TR2017/000064

§ 371 (c)(1),
(2) Date: Jun. 18, 2019

(87) PCT Pub. No.: WO2018/194524

PCT Pub. Date: Oct. 25, 2018

(65) Prior Publication Data

US 2019/0321868 A1 Oct. 24, 2019

(30) Foreign Application Priority Data

Apr. 20, 2017 (TR) ..... 2017/05906

(51) Int. Cl.

| | |
|---|---|
| ***B08B 7/04*** | (2006.01) |
| ***A47L 1/02*** | (2006.01) |
| ***B08B 1/00*** | (2006.01) |
| ***B08B 1/04*** | (2006.01) |
| ***B08B 3/02*** | (2006.01) |
| ***B08B 3/08*** | (2006.01) |

(52) U.S. Cl.

CPC *B08B 7/04* (2013.01); *A47L 1/02* (2013.01); *B08B 1/002* (2013.01); *B08B 1/04* (2013.01); *B08B 3/024* (2013.01); *B08B 3/08* (2013.01); *A47L 2201/04* (2013.01); *A47L 2201/06* (2013.01); *B08B 2203/0217* (2013.01)

(58) Field of Classification Search

CPC combination set(s) only.
See application file for complete search history.

(56) References Cited

U.S. PATENT DOCUMENTS

2015/0257622 A1 9/2015 Qian

FOREIGN PATENT DOCUMENTS

KR 1020080068165 7/2008
WO 2013076712 A2 5/2013

OTHER PUBLICATIONS

International Search Report and Written Opinion dated Mar. 14, 2018 cited in Application No. PCT/TR2017/000064, 18 pgs.

*Primary Examiner* — Erin F Bergner

(57) ABSTRACT

The window cleaning robot according to the invention has an artificial intelligence-controlled moveable washing system which senses such projections as frames, moldings, composite coating materials, etc. on the facades by means of the sensors disposed thereon and which adjusts the positions of the cleaning brushes in a way to contact with the glass surface evenly. It makes the facade cleaning in high-rise buildings safer with the fans adjusting the axial thrust force according to the speed and direction of the wind in a way not to detach from the surface to be cleaned. It allows saving on time, labor force, and costs in facade cleaning. The robot permits performing the cleaning in glass surfaces and facades in a safe manner eliminating the requirement of human factor.

12 Claims, 3 Drawing Sheets

WINDOW CLEANING ROBOT

TECHNICAL FIELD

The product according to the invention relates to an automated facade cleaning robot which eliminates human factor at the point of cleaning during facade and window cleaning in high-rise buildings, which is able to sense its surrounding thanks to the high technology sensors thereof, and which makes facade cleaning safer and more professional with its artificial intelligence capable of adjusting to the environment conditions.

STATE OF THE ART

Nowadays, various methods are used for performing facade and window cleaning in high-rise buildings. Some of them are as follows;

Climbers: It is the system in which a team of climbers perform the cleaning process by suspending from the roof of the building using a rope. In this system, human is the most efficient factor. There exist different cleaning methods in terms of supplying detergent, water, etc. during cleaning. However, these methods are quite time-consuming and costly.

Crane: If the building is not very high, cleaning is performed by means of a mobile crane; nevertheless, human factor is essential in this method as well, and also it is not much preferred due to the work safety and cleaning costs. In low-rise buildings, on the other hand, cleaning can be made using a bar.

Lift: Lift is another system used for cleaning high-rise buildings and it is more commonly used than climbers. In this method, in which cleaning is performed by a basket connected to the mobile cranes in the rooftop and a cleaning staff mounting on said basket, human factor is the primary parameter. Cleaning supplies lack continuity.

In the state of the art, the Patent Application No. 2007/02991 discloses a window cleaning machine, wherein it comprises a main body, a moveable head, a rotary head (ratchet surface), a spraying nozzle, a sliding extension bar, a rotary head control button, a reservoir, a fixing latch, a charger housing, a detergent reservoir, a detergent reservoir cover, a source of energy, a spraying button, a water pipe; as well as an additional body control button, an additional body spraying button, an additional body reservoir, an additional body fixing latch, an additional body charger housing and a mop, all of which are disposed on the additional body. This machine is not convenient for use in high-rise buildings and it has to be used by at least two people. The present invention, however, performs the cleaning process without requiring human factor in a way to allow cleaning of the upper floors.

OBJECT AND DESCRIPTION OF THE INVENTION

The present invention relates to a window cleaning robot which has been developed for overcoming the aforementioned disadvantages regarding facade cleaning in the known techniques and providing additional advantages in the related technical field.

The product according to the invention is a cleaning robot used for window and facade cleaning in high-rise buildings. The product according to the invention eliminates human factor during the cleaning process of high-rise buildings. In the system which can be remotely controlled by means of a tablet control console, there is no requirement of a person on the robot. It is an automated facade cleaning robot having artificial intelligence which is managed by high technology computer-aided control units.

Within the facade cleaning robot used in high-rise buildings, the artificial intelligence developed by a Codesys based PLC Soft-Control system allows controlling the following units.

The touch control panel allows manual control of the robot functions with its computer-based interface operated by the artificial intelligence. The industrial panel control system transferring the information received from the sensors to the operator.

With the ultrasonic wind speed and direction sensor, the speed and hitting direction of the wind hitting on the robot is controlled, and thus permitting the control of the other units on the robot. Further, upon reaching the wind speed of 30-35 km, which is the working limit of the monorail cranes as determined by the work safety regulations, the robot sends warning information to the operator. The automated facade washing robot senses the building surfaces by means of sensors and adjusts the distance of the washing system such that the facade cleaning will be optimized, and thus allowing the contact of the cleaning brushes with the glass surface evenly. The window cleaning robot used in high-rise buildings keeps the varying weather conditions under control by way of its wind speed sensor and warns the operator and switches to safe mode upon reaching the working limits of the robot. The robot which allows for a high-technology electronic control and operation is revolutionary when it comes to facade cleaning.

DESCRIPTION OF PART REFERENCES

1. Robot Chassis
2. Balloon Wheel
3. Moveable Wheel Mechanism
4. Encoder
5. Encoder Connection Apparatus
6. Crane Connection Apparatus
7. Sensor Connecting Flange
8. Laser Distance Sensor
9. Ultrasonic Distance Sensor
10. Ultrasonic Wind Sensor Connecting Pipe
11. Ultrasonic Wind Sensor
12. Driver Board
13. Servo Motor (Fan Motor)
14. Vanes
15. Fan Shroud
16. Fan Protective Wire
17. Fan Connecting Flange
18. Brush Shroud
19. Auxiliary Brushes
20. Auxiliary Brush Connecting Flange
21. Auxiliary Brush Motor
22. Chain-Wheel Movement System
23. Auxiliary Brush Bearing
24. Main Brush Connecting Flange

25. Main Brush Bearing
26. Main Brush Movement Mechanism
27. Actuator Connecting Piece
28. Actuator
29. Actuator Connecting Flange
30. Linear Distance Sensor
31. Reducer
32. Reducer Connecting Flange
33. Main Brush-Driving Servo Motor
34. Main Brush
35. Solution Tank
36. Ultrasonic Level Sensor
37. Solution Filter
38. Solution Tank Connection Apparatus
39. Solution Tank Stand
40. Solution Pump
41. Nozzle
42. Cable Connection Apparatus
43. Cable Connecting Flange
44. Electrical Connection Socket
45. Electrical Panel
46. Command and Control Display
47. Control Panel
48. Relay Panel
49. Electrical Panel
50. Tosibox
51. Tosibox Panel
52. Electrical Panel
53. WiFi Router
54. Remote Receiver
55. Remote Control
56. Digital Camera
57. Warning Light
58. Outer Shell
59. Support Brackets
60. Shock Absorber Balance Spring
61. Shock Absorber Silicone Bar
62. Shock Absorber Connection Apparatuses
63. Electrically Operated Valve (Tank Selector)
64. Tank Discharge Valve

DETAILED DESCRIPTION OF THE INVENTION

The window cleaning robot according to the invention is a cleaning robot used in window and facade cleaning operations without requiring human factor which senses such projections as frames, moldings, composite coating materials, etc. on the facades by means of the sensors disposed thereon and which is controlled by artificial intelligence that enables it to adjust the positions of the cleaning brushes in a way to contact with the glass surface evenly.

Figure 1:
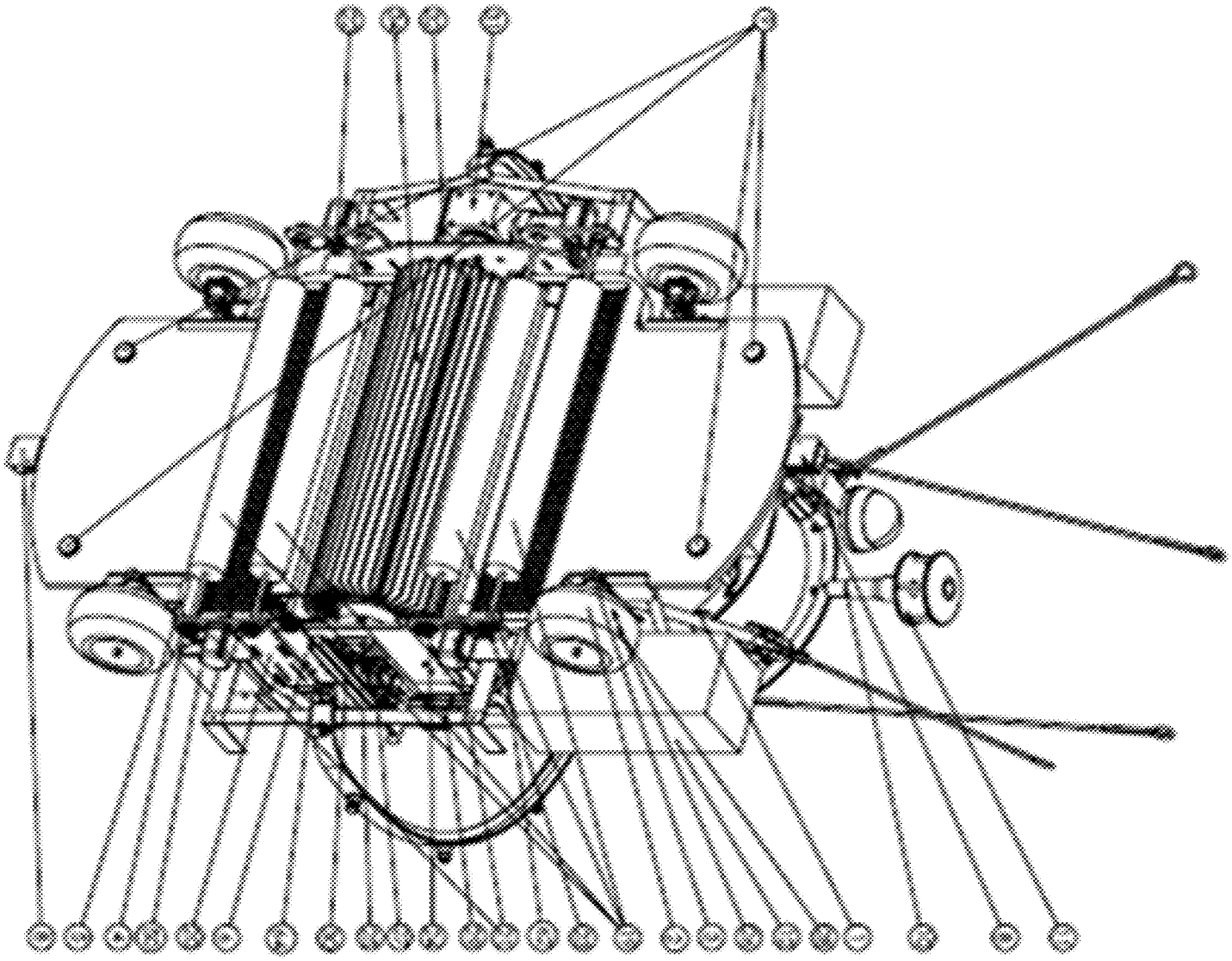
FIG. 1: Front perspective view of the window cleaning robot according to the invention.
Figure 2:
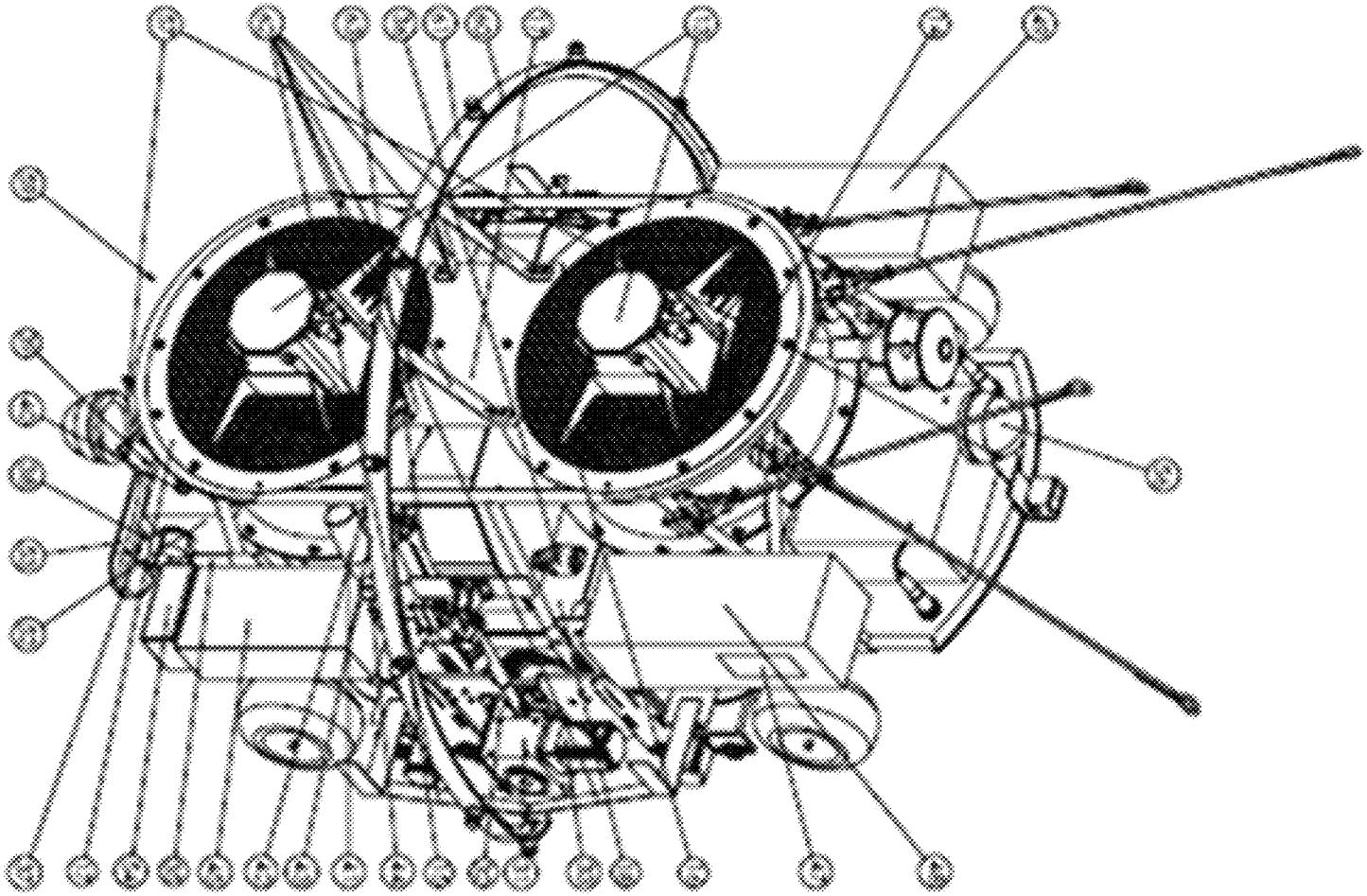
FIG. 2: Rear perspective view of the window cleaning robot according to the invention.
Figure 3:
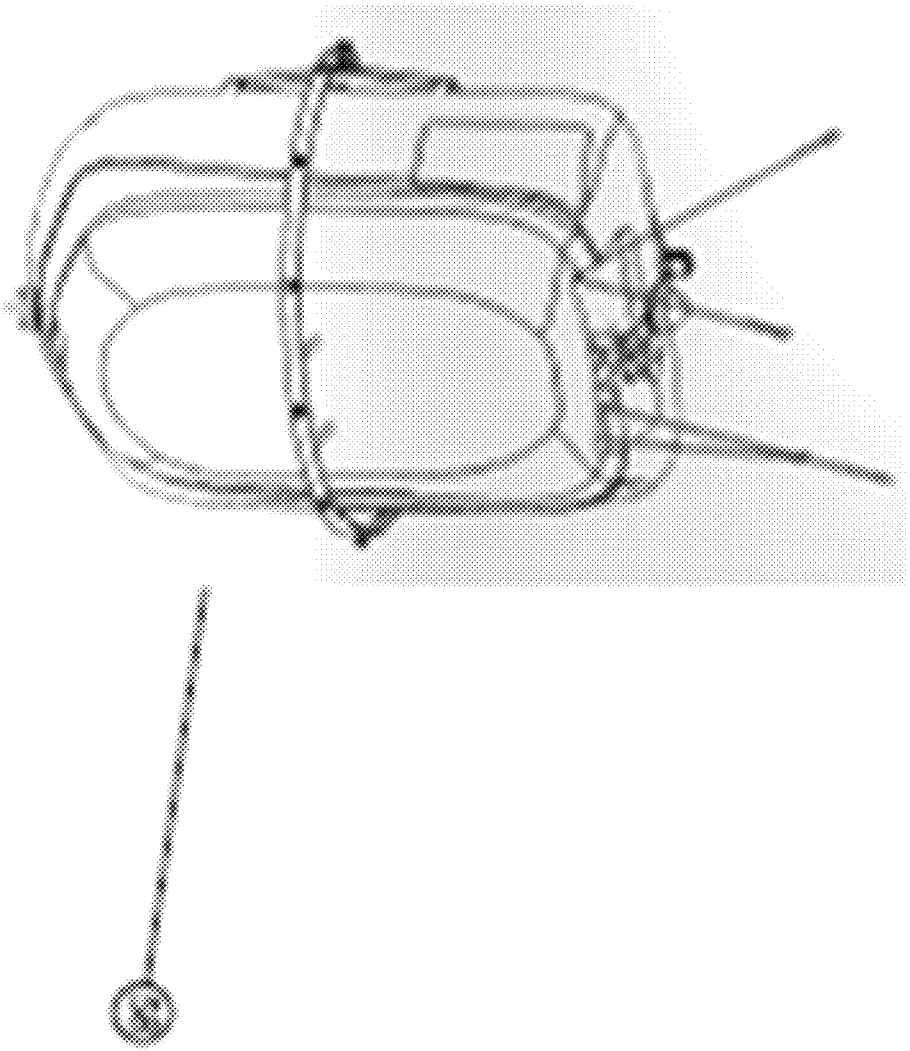
FIG. 3: Perspective view of the window cleaning robot according to the invention when the shell is mounted.

FIGS. 1, 2, and 3 show perspective views from different angles and also in closed position, along with the part reference numerals. The facade cleaning robot for high-rise buildings comprises a robot chassis (1) made of titanium profile, balloon wheels (2) which are coated with silicone anti-skid socks and step on the glass surface, a moveable wheel mechanism (3) adjusting the distance between the robot and the surface to be cleaned, an encoder (4) transferring the up and down, speed and direction information of the robot to the artificial intelligence, an encoder connection apparatus (5), crane connection apparatuses (6), sensor connecting flanges (7), a laser distance sensor (8) from which the robot receives lower and upper distance information, an ultrasonic distance sensor (9) measuring the distance between the robot and window, an ultrasonic wind sensor connecting pipe (10), an ultrasonic wind sensor (11) measuring the wind and its speed in the working environment, servo motor driver boards (12) for sensitive control of the fan motors (13), fan motors (servo motors) (13) with high speed and torque, specially produced vanes (14) providing high axial thrust, specially designed fan shroud (15) which increases the vacuum effect on the surface to be cleaned and provides axial thrust, a fan protective wire (16), a fan connecting flange (17), a brush shroud (18) enclosing the main brush, auxiliary brushes (19) aiding in the cleaning and drying process, an auxiliary brush connecting flange (20), auxiliary brush motor (21) driving the auxiliary brushes, an auxiliary brush chain-wheel movement system (22), an auxiliary brush bearing (23), a main brush connecting flange (24), a main brush bearing (25), a main brush movement mechanism (26), an actuator connecting piece (27), an actuator (28) providing the washing system with back-and-forth movement, an actuator connecting flange (29), a linear distance sensor (30) measuring the distance between the brush and window, a reducer (31) increasing the torque of the main brush, a reducer connecting flange (32), a main brush-driving servo motor (33), a main brush (34) which performs cleaning operation by its washing mechanism and specially produced for double glazing, a solution tank (35), and an ultrasonic level sensor (36) measuring the amount of the solution in the solution tank.

The washing system is made up of the solution filter (37), the solution tank connection apparatuses (38), the solution tank stand (39), the solution pump (40) withdrawing the solution from the solution tank and pressure transfers to the nozzles, and the nozzles (41) which wash the surface to be cleaned in micro particles.

Also comprised by the invention are a connection apparatus (42), an electrical connection socket (44) and a cable connecting flange (43) for mounting the electric cable to the robot chassis (1), a residual current relay of the fuses used for power distribution, an electrical panel (45) in IP65 standard including the contactor, a touch soft command and control display (46) by which the robot adjustments are made and the system status information is delivered to the user, a control panel (47) in IP67 standards in which the soft control and power sources are present, a relay panel (48) in IP67 standards, an electrical panel (49) in IP67 standards in which the driver and power source of the servo motors driving the auxiliary brushes are arranged, a Tosibox (50) allowing the remote access to and intervention in the robot, a Tosibox panel (51) in IP67 standards, an electrical panel (52) in IP67 standards in which the driver of the motor driving the main brush and the camera recorder are arranged, a WiFi router (53) permitting wireless information transmission between the robot and the remote control, a remote receiver (54) permitting the radio frequency communication between the robot and the remote control, a remote control (55) which allows controlling tablet PC and the soft control system and at the same time monitoring the surface to be cleaned over the cameras disposed on the robot, a high resolution digital camera (56) for remotely monitoring the surface to be cleaned and detecting any dirt on the surface to be cleaned, warning lights (57), a specially produced outer shell (58) modelled and the aerodynamic structure of which is designed in computer environment, support brackets (59) ensuring the connection between the outer shell and the chassis, a shock absorber balance spring (60), a shock absorber silicone bar (61) used in the balance spring, a shock absorber connection apparatus (62), an electrically operated valve system (63) allowing passage between solution tanks, and a tank discharge valve (64) which deflates the washing system and is used for discharging the tank.

The product according to the invention aids in the drying process of the cleaning solution by creating a vacuum effect on the surface to be cleaned by means of two high-speed fan motors (13). It ensures that the robot contacts with the surface to be cleaned at a constant force by adjusting the axial thrust force by its servo motors having high torque which may be sensitively controlled. The vane (14) and connection elements are designed for regulating the air flow characteristics and increasing the yield between suction and discharge, thereby ensuring that the air flow complies with the working principle of the machine. The vanes (14) are designed such that they will not only regulate the air flow but also provide axial thrust so as to prevent the robot from being detached form the surface to be cleaned at high wind speeds.

For manufacturing the robot chassis (1) of the robot which is designed for working in high-rise buildings, high-strength grade 2 titanium, which is also used in the manufacture of the airframe of the planes, was used.

The brush mechanisms used in the facade cleaning robot may be in two forms: moving and stationary. The brushes used in the washing system have a special bristle design intended for normal and coated glasses but in a way not to damage the double glazing.

In case the robot moves away from the window, the artificial intelligence which controls the distance between the robot and the glass instantaneously by way of ultrasonic distance sensors (9) changes the speed of the fans and increases/decreases the axial thrust force, and thus ensures that the robot contacts with the surface to be cleaned in a constant manner. The artificial intelligence, which also controls the moveable wheel mechanism (3), enables the wheels to contact with the surface to be cleaned evenly by locating the robot chassis (1) parallel to the surface to be cleaned according to the information from the sensors.

It is the mechanism which automatically adjusts the distance between the robot and the surface to be cleaned according to the distance information received from the ultrasonic distance sensor (9) by the moveable wheel mechanism (3). When the robot coincides with any obstacle on the facades, it performs the cleaning process by adjusting the distance between the former and the surface to be cleaned as much as the height of the obstacle.

At the back of the shell portion of the robot is a shock absorber balance apparatus. It serves for preventing the shell (58) and chassis (1) of the robot from hitting the surface to be cleaned in case the robot moves away from the building surface or rotates around its own axis due to the wind in case of a power cut while the robot is cleaning the building surface or in case of any breakdown in the fan motors (13) providing axial thrust. With its soft silicone structure, the shock absorber is designed, in a way to absorb the shock thereon, as a precaution against any damage both in the robot and in the facade in case the robot hits the glass surfaces.

Whereas the devices of the prior art allow working at a maximum height of 50 meters, the product according to the invention is designed such that it will permit working at a height of 250 meters or higher. The wind values measured on the building surfaces and the wind values measured on the building differ since the speed of the wing hitting the building surface somehow changes its direction. The present system is designed such that it will work at wind speeds of 50-55 km with its outer shell having an aerodynamic structure simulated and modelled in computer environment according to lateral winds.

The high resolution digital cameras (56) disposed on the robot make it possible for the operator to instantaneously control the cleaned surfaces or the surfaces to be cleaned. The digital camera (56) images are recorded by NVR recorder. Thanks to the infrared lighting property of the cameras, the surface to be cleaned can be easily monitored while performing cleaning operation during the night time.

A smart dosing system has been developed which permits a homogeneous spraying of the high-pressure cleaning solution through the nozzles (41) to the cleaning brushes (19, 34) by way of the artificial intelligence-controlled solution pump. It is the artificial intelligence that decides the amount of the solution to be used for cleaning according to the crane speed information that it receives from the encoders (4) disposed in the moveable wheel mechanism (3).

Provided on the robot are two specially designed solution tanks (35). The automated controlled storage system makes it possible to apply two different types of cleaning solutions at the same time; moreover, the amount of the stored solution is doubled in the applications in which a single type of solution is used. It is possible to perform the washing and rinsing operations using different types of solutions since the dirt on the facades of the buildings has different chemical properties. The solution to be used is delivered to the tank selector (63) system from the discharge points of the tanks through a hose. Special level sensors (36) are used for measuring the amount of solution for both of the tanks. The information received from the level sensors (36) are sent to the artificial intelligence, and thus the amount of solution in the solution tanks can be instantaneously monitored.

The artificial intelligence-controlled automated storage selector (63) system allows sequential use of the solutions with different properties according to the cleaning method to be applied to the facade, said system being present between the solution tanks and high-pressure solution pump (40).

The Tosibox (50) modem arranged on the robot allows access to the soft control system and the artificial intelligence interface via the internet. It ensures that a secure connection with the robot is made using different 1024-bit encryption types during every communication with the robot. It allows remotely monitoring and controlling the robot functions and is capable of sending information to the technical service in cases when periodic maintenance and part replacement are required. It is used for finding solutions quickly in cases requiring remote intervention in the robot.

Remote access to all of the robot functions has been made possible by accessing to the soft control screen by the touch-screen computer-controlled remote control. The images of the cameras disposed on the robot are transmitted to the operator by the main command control computer. The communication between the robot and the main control console command is ensured by two communication systems: Wi-Fi and radio-frequency.

The invention claimed is:

1. A robotic device for cleaning the exterior of high-rise buildings, the robotic device comprising:

a robot chassis composed of titanium, a movable wheel mechanism which moves inflatable balloon wheels covered with silicone anti-slip socks for pressing on a glass surface, an encoder transmitting up-down movements, speed and direction information of the robotic device to a control unit, a laser distance sensor which receives upper and lower distance information of the robotic device, an ultrasonic distance sensor measuring the distance between the robotic device and the glass, a linear distance sensor measuring the distance between the brush and the glass an ultrasonic wind sensor measuring the wind speed in a work area, driver boards providing control of fan servo motors, the fan including propellers providing axial thrust, and a fan hood which provides a vacuum effect and axial thrust on a cleaning surface, the fan further including protection wire, connecting flange, a main brush for cleaning and drying the glass surface including a brush hood covering the main brush a main brush connection flange, a main brush bedding bearing, a main brush movement mechanism including a servo motor, a reducer for increasing the torque of the main brush multiple auxiliary brushes including a connection flange, a motor for driving the auxiliary brushes, an auxiliary brush chain-tooth motion system, a washing system including an actuator providing back and forth movements to the washing system;

a solution tank including an ultrasonic level sensor measuring the amount of solution in the solution tank.

2. The robotic device of claim 1, wherein the robotic device can move the brush system with the moving washing mechanism without leaving the cleaning surface by adjusting the axial thrust fans, can detect the amount of dirt on the cleaning surface and prepare the appropriate solution mixture, and comprises mechanisms that pulverize and spray the solution homogeneously.

3. The robotic device of claim 2, wherein the robotic device helps the drying process of the cleaning solution by creating a vacuum effect on the cleaning surface with the fan servo motors and provides contact of the robotic device with the cleaning surface with constant force by adjusting the axial thrust force with the fan servo motors.

4. The robotic device of claim 3, wherein the propellers are designed to ensure axial thrust and to adjust the air flow rate to prevent the robotic device from being disjointed from the cleaning surfaces in case of high wind speeds.

5. The robotic device of claim 4, wherein the robot chassis is composed of grade 2 titanium material.

6. The robotic device of claim 5, wherein the control unit changes the speed of the fans in case the robotic device moves away from the window, increases-decreases the axial thrust force, controls the constant contact of the robotic device to the cleaning surface, and the ultrasonic distance sensors that measure the distance between the robotic device and the window; wherein the control unit also controls the movable wheel mechanism to place the robot chassis in parallel to the cleaning surface and ensures equal contact of the wheels.

7. The robotic device of claim 6, wherein the robotic device comprises a mechanism which automatically adjusts the distance between the robotic device and the surface to be cleaned according to the distance information received from the ultrasonic distance sensor by the moveable wheel mechanism, and performs, when the robotic device coincides with any obstacle on facades, the cleaning process by adjusting the distance between the robotic device and the surface to be cleaned as much as the height of the obstacle.

8. The robotic device of claim 7, further comprising a shock absorber balance apparatus at the back of a shell portion including a soft silicone structure of the robotic device configured for preventing the shell and robot chassis from hitting the surface to be cleaned in case the robotic device moves away from the building surface or rotates around its own axis due to the wind in case of a power cut while the robotic device is cleaning the building surface or in case of any breakdown in the fan motors providing axial thrust; and the shock absorber is designed, in a way to absorb the shock thereon, as a precaution against any damage both in the robotic device and in the facade in case the robotic device hits the glass surfaces.

9. The robotic device of claim 1, further comprising: high resolution digital cameras disposed on the robotic device configured to allow for an operator to instantaneously control the robotic device cleaning operation the digital camera images are recorded by NVR recorder; and wherein the digital cameras further comprise infrared lighting configured to allow the surface to be cleaned to be monitored while performing cleaning operation during night time.

10. The robotic device of claim 9, further comprising: a dosing system which permits the homogeneous spraying of the cleaning solution through nozzles to the cleaning brushes by way of a solution pump; and the control unit decides the amount of the solution to be used for cleaning according to the crane speed information received from the encoders disposed in the moveable wheel mechanism.

11. The robotic device of claim 10, further comprising: two solution tanks; an automated controlled storage system configured to allow applying two different types of cleaning solutions at the same time and allows performing the washing and rinsing operations using different types of solutions for dirt on the facades of the buildings having different chemical properties; the solution to be used is delivered to a tank selector system from the discharge points of the tanks through a hose; level sensors for measuring the amount of solution for both of the tanks; and information received from the level sensors are sent to the control unit, and wherein the amount of solution in the solution tanks can be instantaneously monitored.

12. The robotic device of claim 11, wherein the tank selector system allows sequential use of the solutions with different properties according to a cleaning method to be applied to the facade, the tank selector system being present between the solution tanks and the solution pump.

* * * * *